US006183586B1

(12) United States Patent
Heidelberger

(10) Patent No.: US 6,183,586 B1
(45) Date of Patent: Feb. 6, 2001

(54) PROCESS AND APPARATUS FOR THE PRODUCTION OF A PADDING MATERIAL AND PADDING MATERIAL PRODUCED WITH THIS PROCESS AND APPARATUS

(76) Inventor: Peter Heidelberger, Webergasse 37, D-87435 Kempten (DE)

( * ) Notice: Under 35 U.S.C. 154(b), the term of this patent shall be extended for 0 days.

(21) Appl. No.: 08/872,565

(22) Filed: Jun. 10, 1997

(30) Foreign Application Priority Data

Jun. 18, 1996 (DE) ..... 196 24 164

(51) Int. Cl.[7] ..... B31F 1/00

(52) U.S. Cl. ..... 156/183; 156/200; 156/216; 156/221; 156/269; 493/407; 493/464; 493/967

(58) Field of Search ..... 493/967, 464, 493/407; 156/270, 201, 202, 203, 216, 183, 199, 200, 221, 269; 264/167, 168, 282, 296, 286, 287

(56) References Cited

U.S. PATENT DOCUMENTS 1,680,203 * 8/1928 Cannard ..... 162/113
3,650,877 * 3/1972 Johnson ..... 428/222
4,085,662 * 4/1978 Ottaviano ..... 493/354

* cited by examiner

*Primary Examiner*—Michael W. Ball
*Assistant Examiner*—Gladis Piazza
(74) *Attorney, Agent, or Firm*—Collard & Roe, PC

(57) ABSTRACT

A process is for the production of a padding material (7) made from paper or similar flat structures that are folded together and are formed by tools. At least one intermediate layer (3, 4) is perhaps incorporated within a top layer (2) that is to be folded together. The top layer and the intermediate layer that may or may not be provided are formed along their narrow sides by at least one forming tool (10, 11) after the top layer has been folded together. An intermittent transport unit acts on the structure (1) that is still flat but has been folded together. This causes the structure to be formed longitudinally, in addition to the forming that is carried out by the forming tool (10, 11).

8 Claims, 3 Drawing Sheets

PROCESS AND APPARATUS FOR THE PRODUCTION OF A PADDING MATERIAL AND PADDING MATERIAL PRODUCED WITH THIS PROCESS AND APPARATUS

BACKGROUND OF THE INVENTION

1. Field of the Invention

This process is for the production of a padding material made from paper or similar flat structures that are folded together and is formed by tools. At least one intermediate layer is perhaps incorporated into a top layer that is to be folded together. The top layer and the intermediate layer that may or may not be provided are formed along their narrow sides by at least one forming tool after the top layer has been folded together.

2. The Prior Art

In the past, padding materials of this kind have been formed by using gear wheels that are at the same time responsible for transporting the paper or similar material during the forming operation. When gear wheels are used, there is, however, a danger that the paper or similar material will start to tear. Also this tearing will tend to continue when the material is being put to its intended use.

SUMMARY OF THE INVENTION

It is an object of the present invention to provide a process by which padding material can be formed very effectively, but in a way that is also very gentle to the padding material.

This object is achieved according to the present invention by providing an intermittent transport unit. This unit acts on the structure that is still flat but after it has been folded together. This causes the structure to be elongated longitudinally, in addition to the indenting along the sides that is carried out by the forming tool. This means that the structure is not only formed including depressions along its side edges but is also compressed and extended longitudinally. The result is that both of these forming operations can be carried out less intensively and thus more gently. It is sufficient for the invention if the structure is only folded together loosely. However, it is preferable if the two strips of the structure overlap.

The present invention is directed to a process for the production of a padding material made from a flat structure that is folded together and is formed by tools, comprising the steps of folding together a top layer of a flat structure optionally incorporating perhaps at least one intermediate layer in said top layer that is folded together, said top layer and said intermediate layer having a narrow end forming the top layer and the intermediate layer that may or may not be provided at each's narrow end by at least one forming tool after the top layer has been folded together; and an intermittent transport unit acting on the structure that is still flat but has been folded together and said intermediate transport unit causing the structure to be formed longitudinally, in addition to the forming that is carried out by at least one forming tool.

Also the present invention is directed to a padding material comprising a top layer having two edge strips which is folded together along said two edge strips; optionally at least one intermediate layer surrounded by said top layer; said padding material having a longitudinal direction and having a left side longitudinal edge and a right side longitudinal edge; said padding material having a wide top side and wide bottom side and having a narrow left side and a narrow right side; said padding material provided on at least one longitudinal edge with depressions; and wherein the padding material is formed in the longitudinal direction by compression applied at right angles to the longitudinal direction.

In addition, the present invention is directed to an apparatus for the production of a padding material comprising a folding unit for folding together a top layer of the padding material in such a way that a sleeve is formed which is closed at least to a large extent; and said top layer having two longitudinal side edges.

In a further embodiment of the invention, the two edge strips of the top layer are only folded on top of each other to overlap minimally. These two edge strips can be bonded together by means of adhesive or gluing or a similar forming process. Since the material is first of all compressed longitudinally, excellent padding material can be produced even if the edge strips only overlap to a minimum extent. When a higher degree of forming is required, the padding material can, however, be made even more stable by gluing the edge strips together as well.

In another embodiment of the invention, the two edge strips of the top layer do not overlap; and both edge strips are possibly bonded to an adjacent intermediate layer by gluing.

In another embodiment of the invention the intermediate layer is at most the same width as the top layer after it has been folded together. This structure is both simple to fold together and easy to form as a result.

In a further embodiment of the invention, the edge areas of the top layer are located on the top side or the bottom side of the padding material. Here the forming tools engage the side edges of the padding material.

In another embodiment of the invention, a cross-cutting unit is provided behind the forming tools in the downstream direction in which the padding material is transported. This unit cuts sections of the padding material off the web of padding material at right angles to the direction of transport.

In a further embodiment of the process in accordance with the invention, the cross-cutting unit is activated when the padding material is not engaged by the lateral forming tools. The advance or forward movement in the downstream direction is attributable to the lateral forming tools and is not taking place at this moment. Thus, the padding material is therefore only being transported forward to an insignificant extent if at all. Thus, fully effective cutting of the material by the cross-cutting unit can be guaranteed.

In a preferred embodiment of the process in accordance with the invention, the intermittent forward advance speed of the structure (which is still flat) is higher than the transport speed of the forming tools.

When the advance forward movement is being carried out, this means that the structure is compressed and narrowed longitudinally, while this operation is followed by the transverse forming operation.

The padding material of the invention has a top layer which is folded together and which possibly surrounds at least one intermediate layer. The padding material is provided on at least one of its longitudinal edges with depressions. It is formed in the longitudinal direction by compression applied at right angles to the longitudinal direction.

A padding material of this kind has proved to be an excellent way to support objects that need to be packaged, while paper or a similar material that is inexpensive to produce can be used at least for the intermediate layer. The top layer can, however, be made from paper or a similar material with lower tear strength properties also. This is because the material is treated very gently due to the fact that the lateral depression forming and the longitudinal compression operations are carried out separately.

Another embodiment of the padding material in accordance with the invention can be used for special applications. Here the two edge strips of the top layer are bonded together or to an adjacent intermediate layer by means of adhesive such as by gluing. The glued seam is located on one wide top or bottom side of the structure, while the forming operations are carried out on the narrow lateral sides of the structure.

In an apparatus embodiment of the invention, a folding unit is provided in which a top layer of the padding material is folded together in such a way that a sleeve is formed. This sleeve is closed at least to a large extent.

In addition, a loading apparatus is provided with which at least one intermediate layer is inserted into the sleeve. In a further embodiment of the invention, a gluing unit is provided in which the two longitudinal edges of the top layer are glued together or are glued to the adjacent intermediate layer. It is also possible in accordance with the invention to provide a forming shaft in which at least one forming tool is located that engages a side edge of the top layer.

In another embodiment of the invention, two forming tools are provided and located opposite to each other. Means are provided to drive them in synchronization so that they will clamp and form depressions in the side walls of the padding material positioned between them. In another embodiment of the invention, the forming tools are pivoted, and are driven in opposite directions. Each forming tool has at least one forming arm. This makes certain that the forming tools are simple to produce and will operate reliably. As a result of using two forming tools, the padding material is substantially narrowed as these depressions are being formed.

In a further embodiment of the invention, each of the forming tools has two forming arms that are positioned diametrically opposite each other. A structural configuration of this kind with two forming arms has proved to be particularly advantageous, although it is also possible to have more forming arms.

In another embodiment of the invention, every forming arm has at least two forming fingers at its free end. The padding material is formed even more effectively as a result.

In a further embodiment of the invention, a cross-cutting unit is located downstream after the forming tools. It is also possible in this embodiment for the cross-cutting unit to be located at the downstream end of the forming shaft. Another embodiment of the invention has the cross-cutting unit equipped with a cutting knife that reciprocates and moves backwards and forwards. This knife engages a support located at the downstream end of the forming shaft.

In another embodiment of the invention, an intermittently operating transport unit is provided for the structure (which is still flat). This unit is located before the forming tools in the direction of movement of the structure/padding material. The transport speed of the transport unit is higher than the speed of the forming tools. This apparatus makes it possible to produce a padding material from paper or a similar flat material both simply and reliably.

BRIEF DESCRIPTION OF THE DRAWINGS

Other objects and features of the present invention will become apparent from the following detailed description considered in connection with the accompanying drawing which discloses several embodiments of the present invention. It should be understood, however, that the drawing is designed for the purpose of illustration only and not as a definition of the limits of the invention.

In the drawing, wherein similar reference characters denote similar elements throughout the several views.

DETAILED DESCRIPTION OF PREFERRED EMBODIMENTS

Figure 1:
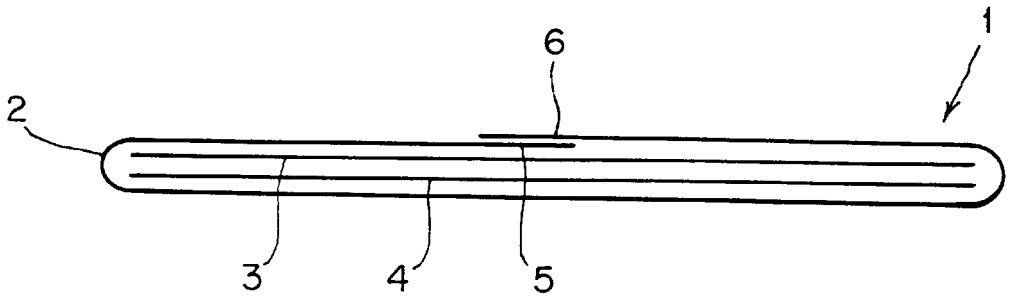
FIG. 1 shows a cross-section through a structure that has been folded together and is still flat.

Turning now in detail to the drawings, FIG. 1 shows a flat paper structure that includes a top layer 2 and two intermediate layers 3 and 4. The top layer 2 has been folded around the two intermediate layers 3 and 4. The two edge strips 5 and 6 of the top layer are located on the upper side of the paper structure 1, where edge strips 5 and 6 overlap.

The two overlapping edge strips 5 and 6 may be resting loosely on top of each other or they may be glued together. It is also possible to have the two edge strips 5 and 6 simply butt against each other or end a certain distance apart from each other. If higher strength is required in the latter two cases, the two edge strips 5 and 6 can be glued to the adjacent intermediate layer.

Any other flexible flat material, such as plastic film for example a polyolefin like polyethylene, or a non-woven fabric or fiber board can be used instead of paper for both the top layer 2 and for the intermediate layer 3 or 4. Depending on the requirements, it is possible to provide only one intermediate layer or to have several intermediate layers. It is also feasible to have no intermediate layers at all.

After it has been produced, this paper structure 1 can be rolled up and fed into a separate forming station or it can be fed directly into a forming unit. This operation leads to the creation of a padding material 7 that has approximately the shape illustrated in FIG. 2. Padding 7 is very suitable for use as padding material in transport packaging.

Figure 3:
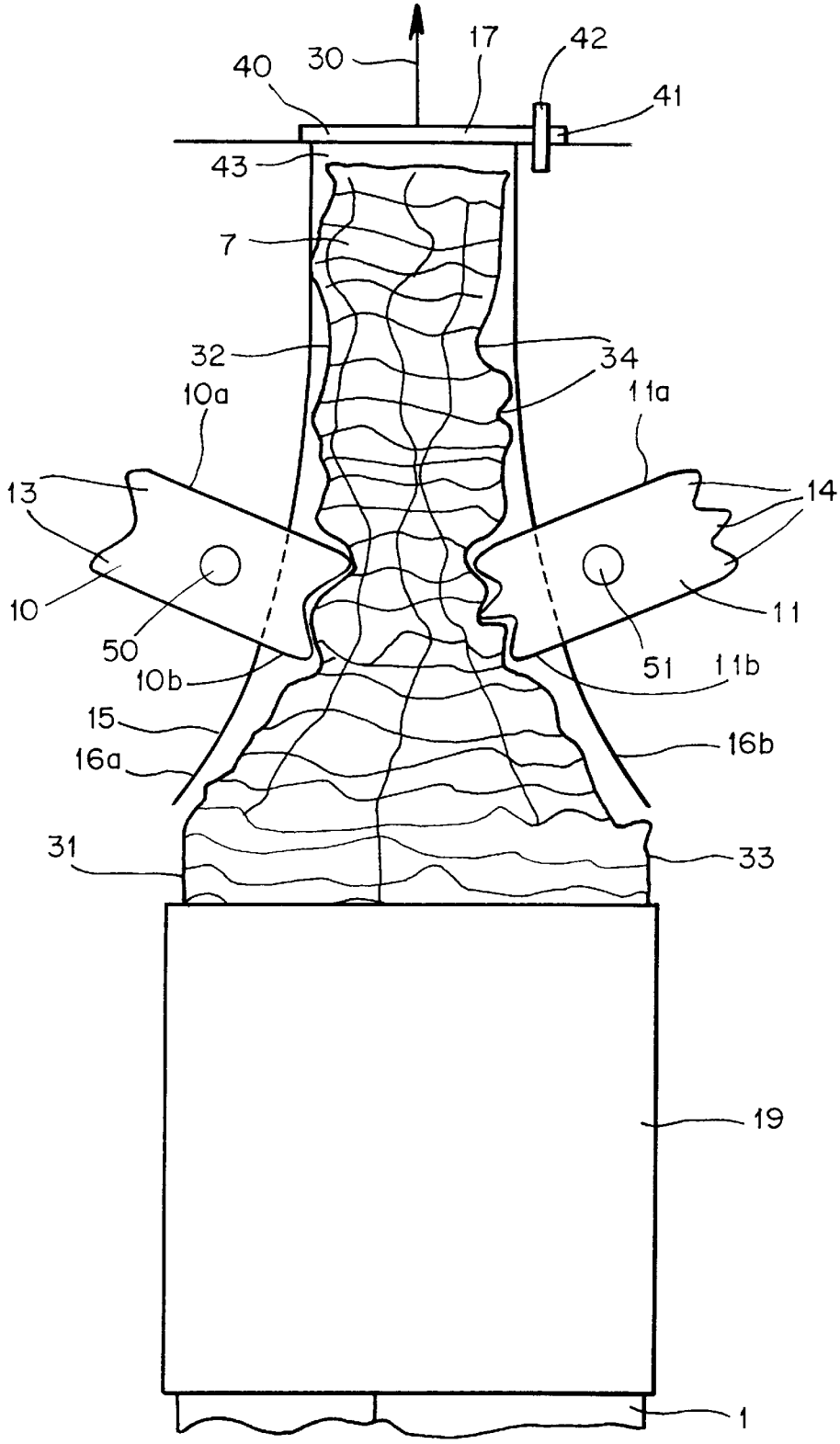
FIG. 3 shows a top view of an apparatus for producing the padding material illustrated in FIG. 2.

FIG. 3 shows an apparatus for converting the paper structure 1 into a padding material 7. Two forming tools 10 and 11 that are driven in opposite directions and are synchronized by a pair of gear wheel or pivots 50 and 51 which are provided for this purpose. The two forming tools 10, 11 each have two arms such as arms 10*a* and 10*b* for tool 10 and arms 11*a* and 11*b* for tool 11. Each arm can either have two fingers 13 (as is shown for forming tool 10) or each arm can have three fingers 14 (as is shown for forming tool 11). Whichever structure is chosen, however, both of the forming tools are identical. It is also possible to configure the two forming tools so that the free end of each is rounded. A further embodiment is to design the forming tools so that they have more than two arms. The two forming tools are located inside a forming shaft 15, which comprises a left side lateral guide plate 16*a* and a right side lateral guide plate 16*b*. A cross-cutting unit 17 that divides the padding material 7 up into individual sections of the required length is provided at the downstream end of the forming shaft.

Figure 2:
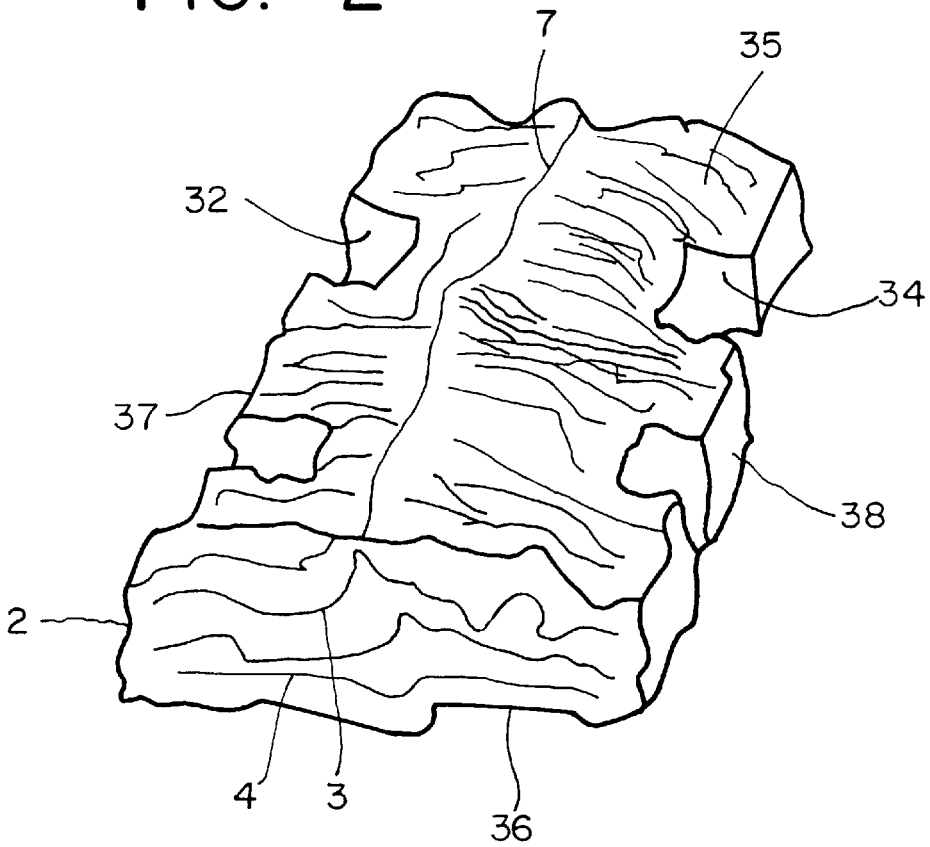
FIG. 2 shows what the padding material looks like after completion of the forming operations.

The padding material 7 has a longitudinal or forward direction 30 as indicated by the arrow shown in FIG. 3. The padding material has left side longitudinal edge 31 with left side depressions 32 and has right side longitudinal edge 33 with right side depressions 34. The padding material has a wide top side 35 and wide bottom side 36. The padding material 7 has a narrow left side 37 and has a narrow right side 38, as shown in FIG. 2.

Figure 4:
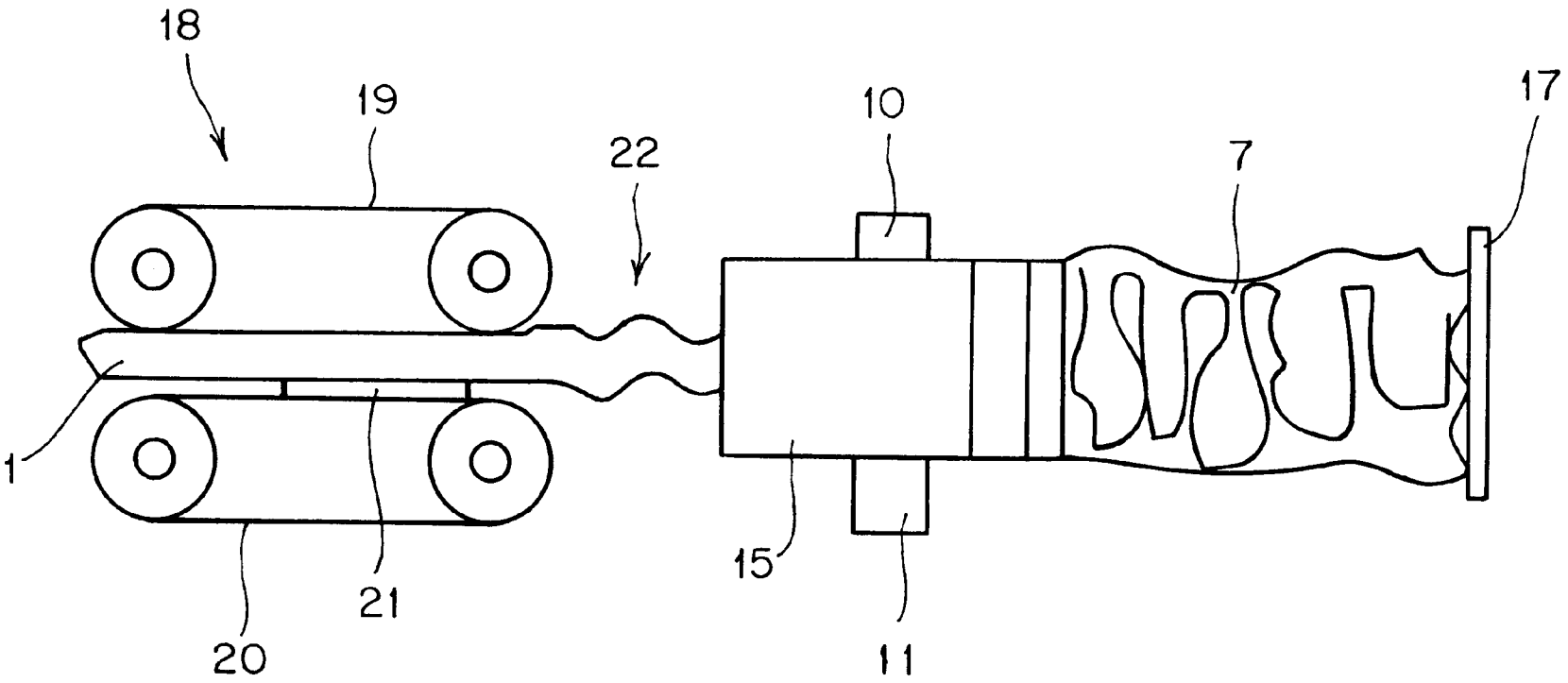
FIG. 4 shows a side view of the apparatus illustrated in FIG. 3.

FIG. 4 shows a transport unit 18, that includes two conveyor belts 19 and 20. In addition, transport unit 18 is located directly before the forming tools 10, 11 that engage the structure laterally, as can be seen in FIG. 3. The two conveyor belts are far enough apart to allow the flat paper structure 1 to pass through without touching these belts. One of the two conveyor belts has a raised area 21 in one specific section of the belt. When this raised area 21 is moved upwardly to be between the two conveyor belts, the paper structure is transported. When area 21 is moved downwardly and is not between belts 19 and 20, the structure is not transported. Thus transport unit 18 and the raised area 21 operate intermittently, and essentially operate independently from the forming tools 10 and 11. Thus, the gear wheel connections involving "prime" gear wheels are provided between the lateral forming tools 10 and 11 and the transport unit 18. As a result of this, a drive system is achieved that is to a very large extent independent. Since the transport unit runs faster than the forming tools, the paper structure 1 is compressed longitudinally, as is indicated by the reference number 22.

The cross-cutting unit 17 located at the downstream end only operates when the forming tools 10 and 11 are not engaged. Thus, unit 17 operates when there is not therefore any significant forward movement of the padding material. Unit 17 has a cutting knife 40 that reciprocates backwards and forwards by reciprocating means 41 and which engages support means 42 located at the downstream end 43 of the forming shaft 15.

While several embodiments of the present invention have been shown and described, it is to be understood that many changes and modifications may be made thereunto without departing from the spirit and scope of the invention as defined in the appended claims.

What is claimed is:

1. Process for the production of a padding material made from a flat structure that is folded together and is formed by tools, comprising the steps of folding together a top layer of a flat structure;

optionally incorporating at least one intermediate layer in said top layer that is folded together, said top layer and said intermediate layer having a narrow end;

forming the top layer and the intermediate layer that may or may not be provided at each's narrow end by at least one forming tool after the top layer has been folded together; and wherein said forming tool indents the structure and causes depressions along side edges of the structure; and an intermittent transport unit acting on the structure that is still flat but has been folded together and said intermittent transport unit causing the structure to be formed longitudinally in a longitudinal direction, in addition to the forming that is carried out by at least one forming tool; and said being formed longitudinally comprising compression applied at right angles to the longitudinal direction.

2. Process according to claim 1, wherein said top layer has two edge strips;

and further comprising folding said two edge strips of the top layer only on top of each other to overlap minimally; and bonding said two edge strips together.

3. Process according to claim 1, wherein there is an adjacent intermediate layer; and said top layer has two edge strips;

and further comprising having said two edge strips of said top layer avoiding overlapping; and bonding said two edge strips to said adjacent intermediate layer.

4. Process according to claim 1, wherein an intermediate layer is provided and is at most the same width as the top layer after the top layer has been folded together.

5. Process according to claim 1, wherein said top layer has two edge strips, and wherein said padding material has a top side and a bottom side and has side edges; and wherein the edge strips of the top layer are located on the top side or bottom side of the padding material, while lateral forming tools engage the side edges of the padding material.

6. Process according to claim 1, further comprising providing a cross-cutting unit behind lateral forming tools in a direction of transport in which the padding material is transported; said cross-cutting unit cutting sections of the padding material off a web of padding material at right angles to the direction of transport.

7. Process according to claim 6, further comprising activating the cross-cutting unit when the padding material is not engaged by lateral forming tools.

8. Process according to claim 1, further comprising having an intermittent advance speed of the structure higher than a transport speed of the forming tools.

* * * * *